US008166722B2

(12) United States Patent
Moller, Jr.

(10) Patent No.: US 8,166,722 B2
(45) **Date of Patent: *May 1, 2012**

(54) MODULAR FLOOR TILE SYSTEM WITH TRANSITION EDGE

(75) Inventor: Jorgen J. Moller, Jr., Salt Lake City, UT (US)

(73) Assignee: Snap Lock Industries, Inc., Salt Lake City, UT (US)

( * ) Notice: Subject to any disclaimer, the term of this patent is extended or adjusted under 35 U.S.C. 154(b) by 39 days.

This patent is subject to a terminal disclaimer.

(21) Appl. No.: 12/623,203

(22) Filed: Nov. 20, 2009

(65) Prior Publication Data

US 2010/0083608 A1 Apr. 8, 2010

Related U.S. Application Data

(63) Continuation of application No. 10/898,494, filed on Jul. 23, 2004, now Pat. No. 7,690,160.

(51) Int. Cl.
*E04F 13/00* (2006.01)

(52) U.S. Cl. ..... 52/588.1; 52/177; 52/589.1; 52/591.1; 52/506.1; 52/384; 52/390; 52/403.1; 52/561; 404/35; 404/41

(58) Field of Classification Search ..... 52/591.1, 52/589.1, 592.1, 656.1, 656.9, 582.2, 582.1, 52/391, 716.1, 717.03, 717.05, 718.04, 177–180, 52/384–385; 428/44–45, 33, 49, 53, 55, 428/169, 60; 15/215, 238; 404/39, 41, 42, 404/35

See application file for complete search history.

(56) References Cited

U.S. PATENT DOCUMENTS

| | | | | |
|---|---|---|---|---|
| 738,704 | A | 9/1903 | Semmer | |
| 1,420,775 | A | 6/1922 | Stanwood | |
| 1,625,187 | A | 4/1927 | Birch | |
| D93,991 | S | 12/1934 | Moore | |
| 2,264,401 | A | 10/1938 | Page et al. | |
| D165,982 | S | 2/1949 | Kennedy | |
| 3,196,763 | A | 7/1965 | Rushton | |
| 3,279,138 | A | 10/1966 | Dittmar | |
| 3,284,819 | A | 11/1966 | Nissen | |
| 3,310,917 | A | 3/1967 | Simon | |
| 3,310,919 | A * | 3/1967 | Bue et al. | 52/127.11 |
| 3,319,392 | A | 5/1967 | Fitzgerald | |
| 3,717,247 | A | 2/1973 | Moore | |
| 3,909,996 | A | 10/1975 | Ettlinger, Jr. et al. | |
| 4,226,060 | A | 10/1980 | Sato | |
| 4,287,693 | A | 9/1981 | Collette | |
| 4,373,306 | A * | 2/1983 | Rech | 52/98 |
| 4,383,397 | A | 5/1983 | Ward | |
| D274,588 | S | 7/1984 | Swanson et al. | |
| D274,948 | S | 7/1984 | Swanson et al. | |
| 4,468,910 | A * | 9/1984 | Morrison | 52/591.2 |

(Continued)

OTHER PUBLICATIONS

"Garage Creations-Multipurpose Flooring Accessory-Peg Edge Piece;" www.amazon.com, 2 pages, undated.

(Continued)

*Primary Examiner* — Jeanette Chapman
(74) *Attorney, Agent, or Firm* — Holland & Hart

(57) ABSTRACT

The present invention provides a modular flooring system including a ramp to facilitate entry and exit from the flooring system. The ramp may be modular and interconnect with all or parts of a perimeter of the flooring system, and the ramp may also interconnect with adjacent ramp members.

36 Claims, 4 Drawing Sheets

U.S. PATENT DOCUMENTS 4,497,858 A * 2/1985 Dupont et al. ..... 428/44
4,543,765 A 10/1985 Barrett
4,561,232 A 12/1985 Gladden, Jr. et al.
4,584,221 A 4/1986 Kiing
4,715,743 A 12/1987 Schmanski
4,860,510 A 8/1989 Kotler
4,930,286 A 6/1990 Kotler
5,014,488 A 5/1991 Evangelos et al.
5,033,241 A 7/1991 Max
5,228,253 A 7/1993 Wattelez
5,275,502 A 1/1994 Glaza et al.
5,323,575 A 6/1994 Yeh
5,403,637 A 4/1995 Pickard et al.
5,446,937 A 9/1995 Haskins
5,470,140 A 11/1995 Schagunn
5,509,244 A 4/1996 Bentzon
5,527,128 A 6/1996 Rope et al.
5,630,304 A 5/1997 Austin
5,634,309 A 6/1997 Polen
D383,253 S 9/1997 Semenuk
D385,974 S 11/1997 Berger
D385,978 S 11/1997 Berger
D391,378 S 2/1998 Bannister
5,713,806 A 2/1998 Teitgen et al.
5,761,867 A 6/1998 Carling
5,787,654 A 8/1998 Drost
5,815,995 A 10/1998 Adam
5,833,386 A 11/1998 Rosan et al.
5,857,578 A 1/1999 Fishman
5,863,030 A 1/1999 Kotler
5,904,021 A 5/1999 Fisher
5,950,378 A 9/1999 Council et al.
D415,471 S 10/1999 Henry
5,992,106 A 11/1999 Carling et al.
6,032,428 A 3/2000 Rosan et al.
6,042,915 A 3/2000 Kessler
6,098,354 A 8/2000 Skandis
6,127,015 A * 10/2000 Kessler ..... 428/45
6,128,881 A * 10/2000 Bue et al. ..... 52/582.2
6,189,283 B1 * 2/2001 Bentley et al. ..... 52/587.1
6,332,941 B1 12/2001 Council et al.
D456,533 S 4/2002 Moller, Jr.
D462,130 S 8/2002 Kotler
D462,792 S 9/2002 Ogawa
6,467,224 B1 10/2002 Bertolini
6,505,444 B1 * 1/2003 Johnson ..... 52/177
6,526,705 B1 3/2003 MacDonald
6,562,414 B2 5/2003 Carling
6,591,575 B2 * 7/2003 Benedettini ..... 52/716.1
D481,138 S 10/2003 Carling et al.
D481,470 S 10/2003 Moller, Jr.
6,684,582 B2 2/2004 Peart et al.
6,694,689 B1 2/2004 Scott et al.
6,718,588 B1 4/2004 Frederiksen
D492,426 S 6/2004 Strickler
6,751,912 B2 6/2004 Stegner et al.
6,802,159 B1 10/2004 Kotler
6,954,975 B2 10/2005 Dolinski
6,966,155 B2 * 11/2005 Nevison ..... 52/177
6,990,777 B2 1/2006 Poliacek et al.
D516,737 S 3/2006 Moller
7,043,792 B2 5/2006 Kessler
7,114,298 B2 10/2006 Kotler
D531,737 S * 11/2006 Shuman et al. ..... D25/55
7,174,682 B2 * 2/2007 Pelosi, Jr. ..... 52/179
7,275,350 B2 10/2007 Pervan et al.
7,299,592 B2 11/2007 Moller, Jr.
D577,444 S 9/2008 Moller, Jr.
7,559,177 B2 * 7/2009 Stanchfield ..... 52/459
7,640,706 B2 * 1/2010 Stanchfield ..... 52/464
7,690,160 B2 4/2010 Moller, Jr.
7,900,294 B2 * 3/2011 Luxton et al. ..... 4/604
2002/0157331 A1 10/2002 Peart et al.
2002/0189176 A1 12/2002 Stegner
2003/0221388 A1 * 12/2003 Benedettini ..... 52/716.1
2004/0058089 A1 3/2004 Forster et al.
2004/0226241 A1 11/2004 Forster et al.
2004/0226242 A1 11/2004 Moller, Jr.
2004/0255547 A1 12/2004 Flowers
2004/0258869 A1 12/2004 Walker
2004/0258870 A1 12/2004 Oakey
2005/0034395 A1 2/2005 Kotler
2005/0108968 A1 5/2005 Forster
2005/0115181 A1 6/2005 Grau
2005/0183370 A1 8/2005 Cripps
2005/0193669 A1 9/2005 Jenkins et al.
2005/0252109 A1 11/2005 Fuccella
2006/0016136 A1 1/2006 Moller, Jr.
2006/0070314 A1 4/2006 Jenkins et al.
2006/0125153 A1 6/2006 Moller, Jr.
2006/0207194 A1 9/2006 Salles, Jr.
2006/0272252 A1 12/2006 Moller, Jr.
2006/0283118 A1 12/2006 Moller, Jr.
2006/0283125 A1 12/2006 Moller, Jr.
2007/0044412 A1 3/2007 Forster et al.
2007/0062131 A1 3/2007 Yokubison et al.
2007/0094969 A1 5/2007 McIntosh et al.

OTHER PUBLICATIONS

"RaceDeck Edges and Corners;" www.garagestyle.com, 2 pages (copyright 2007).
"RaceDeck 3 Edges and Corners;" www.texasgarages.com; 2 pages (copyright 2004-2007).
"Total Garage XFloor;" unknown website, 5 pages (copyright 2007).
"Tylon Display Flooring;" Sport Court Inc. Sales Brochure, 2 pages (copyright 2002).
"Daytona;" www.sportcourt.com/daytona, 4 pages (copyright 2004).
"Mateflex All Purpose Surfacing;" Sales Brochure, 5 pages (circa 1994).
"Athletic & Recreational Surfaces," AmeriTile Product Guide, 9 pages (May 15, 2002).
U.S. Appl. No. 12/623,203, Moller, Jr.
Imformation about Related Patents and Patent Applications, see the section of the accompanying Information Disclosure Statement Letter entitled "Related Patents and Patent Applications" for further information.
Garage Creations—Multipurpose Flooring Accessory—Peg Edge Piece, Amazon.com, see IDS for date information, 2 pages (each page marked GC1).
RaceDeck Edges and Corners, Garagestyle.com, see IDS for date information, 2 pages (each page marked RaceDeck 2).
Total Garage, XFloor, see IDS for date information, 5 pages (each page marked XFLOOR1).
Your Complete Garage Outfitter Source!, Styles and Colors, Texas Garages, see IDS for date information, 2 pages (each page marked RaceDeck1).
Complaint, Apr. 6, 2010, Case No. 10-cv-294 (33 pages).
Sport Court's Answer and Counterclaim, May 28, 2010, Case No. 10-cv-294 (40 pages).
Sport Court's Motion for Leave to Amend Answer and Counterclaim, Aug. 30, 2010, Case No. 10-cv-294 (4 pages).
Sport Court's Memorandum in Support of Motion for Leave to Amend and in Opposition to Motion to Dismiss, Aug. 30, 2010, Case No. 10-cv-294 (250 pages).
Sport Court's Motion to Stay, Sep. 1, 2010, Case No. 10-cv-294 (3 pages).
Sport Court's Memorandum in Support of its Motion to Stay, Sep. 1, 2010, Case No. 10-cv-294 (225 pages).
Sport Court's Motion for Protective Order, Sep. 20, 2010, Case No. 10-cv-294 (3 pages).
Sport Court's Memorandum in Support of Motion for Protective Order, Sep. 20, 2010, Case No. 10-cv-294 (44 pages).
Combined Memorandum in Opposition to Motion for Leave to Amend Answer, Counterclaim, and Reply Memorandum, Sep. 30, 2010, Case No. 10-cv-294 (48 pages).
Memorandum in Opposition to Sport Court's Motion for Protective Order, Oct. 4, 2010, Case No. 10-cv-294 (79 pages).
Memorandum in Opposition to Connor Sport Court International Inc.'s Motion to Stay, Oct. 4, 2010, Case No. 10-cv-294 (24 pages).
Sport Court's Memorandum in Opposition to Plaintiffs Motion for Protective Order, Oct. 8, 2010, Case No. 10-cv-294 (93 pages).

Sport Court's Reply Memorandum in Support of Motion to Amend Complaint, Oct. 18, 2010, Case No. 10-cv-294 (33 pages).
Snap Lock's Reply in Support of its Motion for Entry of Protective Order, 10-212010, Case No. 10-cv-294 (28 pages).
Sport Court's Memorandum in Reply to Plaintiffs Opposition to Sport Court's Motion to Stay, Oct. 21, 2010, Case No. 10-cv-294 (19 pages).
Sport Court's Reply in Support of Plaintiffs Motion for Entry of Protective Order, Oct. 21, 2010, Case No. 10-cv-294 (28 pages).
Sport Court's Second Amended Answer, Affirmative Defenses, and Counterclaim, Oct. 27, 2010, Case No. 10-cv-294 (145 pages).
Snap Lock's Reply to Sport Court's Second Amended Counterclaim, Nov. 15, 2010, Case No. 10-cv-294 (18 pages).
Connor Sport Court International's Motion for Leave to Amend Counterclaim, Dec. 6, 2010, Case No. 10-cv-294 (3 pages).
Memorandum in Support of Connor Sport Court International's Motion for Leave to Amend Counterclaim, Dec. 6, 2010, Case No. 10-cv-294 (42 pages).
Memorandum in Opposition re Connor Sport Court International's Motion for Leave to Amend Counterclaim, Dec. 23, 2010, Case No. 10-cv-294 (33 pages).
Plaintiffs Motion for Summary Judgment of Infringement, Oct. 7, 2011, Case No. 10-cv-294 (2 pages).
Memorandum of Points and Authorities in Support of Plaintiff's Motion for Summary Judgment of Infringement, Oct. 7, 2011, Case No. 10-cv-294 (60 pages).
Plaintiffs Motion for Summary Judgment on Inequitable Conduct Counterclaim, Oct. 7, 2011, Case No. 10-cv-294 (2 pages).
Memorandum in Support of Plaintiff's Motion for Summary Judgment on Inequitable Conduct Counterclaim, Oct. 7, 2011, Case No. 10-cv-294 (75 pages).
Motion for Summary Judgment, Case No. 2:10-CV-00294, filed Nov. 17, 2011.
Sport Court's Memorandum in Support of Motion for Summary Judgment of Patent Invalidity, Case No. 2:10-CV-00294, filed Nov. 17, 2011.
Flyer for Turtle Plastics Paw Pads Modular Floor Tiles, date unknown (1 page).
Photographs of Turtle Plastics Edge Piece (2 views).

* cited by examiner

MODULAR FLOOR TILE SYSTEM WITH TRANSITION EDGE

CROSS-REFERENCE TO RELATED PATENT APPLICATIONS

This is a continuation of U.S. patent application Ser. No. 10/898,494, entitled "Modular Floor Tile System with Transition Edge," filed on 23 Jul. 2004.

TECHNICAL FIELD

This invention relates generally to floor tiles, and more particularly to modular floor systems with a transition edge.

BACKGROUND

Floor tiles have traditionally been used for many different purposes, including both aesthetic and utilitarian purposes. For example, floor tiles of a particular color may be used to accentuate an object displayed on top of the tiles. Alternatively, floor tiles may be used to simply protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Some floor tiles can be interconnected to one another to cover large floor areas such as a garage, an office, or a show floor.

Various interconnection systems have been utilized to connect floor tiles horizontally with one another to maintain structural integrity and provide a desirable, unified appearance. In addition, floor tiles can be manufactured in many shapes, colors, and patterns. Some floor tiles contain holes such that fluid and small debris is able to pass through the floor tiles and onto a surface below. Tiles can also be equipped with special surface patterns or structures to provide various superficial or useful characteristics. For example, a diamond steel pattern may be used to provide increased surface traction on the tiles and to provide a desirable aesthetic appearance.

One method of making plastic floor tiles utilizes an injection molding process. Injection molding involves injecting heated liquid plastic into a mold. The mold is shaped to provide an enclosed space to form the desired shaped floor tile. The liquid plastic is allowed to cool and solidify, and the plastic floor tile is removed from the mold.

The perimeter of typical floor tiles generally comprises an abrupt step or edge. The size of the step is usually equal to the thickness of the floor tile. The thickness of typical floor tiles is generally ¼-¾ of an inch. For many purposes, however, the abrupt step presents a number of problems. For example, a step of ¼ to ¾ of an inch is enough to cause tripping. In addition, it can be difficult to move objects on rollers across the step and onto the floor tiles.

The present invention is directed to overcoming, or at least reducing the effect of, one or more of the problems presented above.

SUMMARY

In one of many possible embodiments, the present invention provides a modular floor edge system. The modular floor edge system comprises a first ramp, the first ramp comprising a leading edge, a major axis and a minor axis, and a substantially vertical back substantially parallel to the major axis. The substantially vertical back comprises a plurality of connecting members removably attachable to a modular floor tile. The first ramp may include a tapered surface, an open webbed structure supporting the tapered surface, and the ramp may be made of plastic. According to some embodiments, the leading edge may comprise a substantially straight portion and a rounded corner. The ramp may include a substantially vertical side surface adjacent to and perpendicular with the substantially vertical back, the side surface comprising a connecting member attachable to another ramp. The plurality of connecting members may include male tabs comprising a generally vertical component and generally horizontal component. The substantially vertical back may also include a female connecting member at one end that is connectable to another ramp. The plurality of connecting members may each comprise a semi-circular tab protruding laterally from the substantially vertical back, such that a curved portion of the semi-circular tab faces a floor. The modular floor edge system may include a second ramp removably attached longitudinally to the first ramp at an interface substantially parallel with the minor axis. The modular floor edge system may also include a second ramp having a major axis and minor axis, the second ramp removably attached perpendicularly to the first ramp at an interface substantially parallel to the minor axis of the first ramp and substantially parallel to the major axis of the second ramp.

Another embodiment of the present invention provides a modular flooring system. The modular floor system comprises a first modular floor panel having a top surface and a plurality of lateral edge connecting members, and a first modular ramp comprising a plurality of connecting members removably attached to one lateral edge of the first modular floor panel. The first modular ramp comprises a tapered surface extending from a leading edge adjacent to a floor to a trailing edge substantially flush with the top surface. The flooring system may comprise a plurality of modular floor panels removably connected with the first modular floor panel to create a polygonal shape having a perimeter. A plurality of modular ramps may be attached to one another and extend around or partially around the perimeter of the polygonal shape. The first modular ramp may comprise an angle ranging between approximately 20-60 degrees with respect to a floor or other support surface. According to some embodiments, the first modular ramp further comprises a top tapered surface and an open webbed structure supporting the top tapered surface. The first modular ramp may comprise injection molded plastic.

Another aspect of the invention provides a method of making a modular flooring edge. The method may include providing an injection mold and injection molding a modular ramp comprising a back having one or more connecting members attachable to a modular floor tile. The method may further include injection molding a side having one or more connecting members attachable to another modular ramp. The injection molding of the modular ramp may include creating an upper ramp surface and a lower webbed support structure. The injection molding of the modular ramp may further include creating a leading edge for placement adjacent to a floor, the leading edge comprising a generally straight portion and a rounded corner portion.

Another aspect of the invention provides a method of building a modular floor. The method may include providing a plurality of modular floor panels of generally rectangular shape comprising lateral edge connectors, and providing a plurality of modular ramps comprising back and side connectors. The method may further include connecting the plurality of modular floor panels to one another via the lateral edge connectors to form a polygonal shape, and connecting the plurality of modular ramps to the modular floor panels around a perimeter of the polygonal shape. Each of the plurality of modular ramps may also be connected to an adjacent one of the plurality of modular ramps.

The foregoing features and advantages, together with other features and advantages of the present invention, will become more apparent when referred to the following specification, claims and accompanying drawings.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

As mentioned above, modular flooring typically includes a top surface that sets above a support surface or floor. It is often difficult to move certain objects onto and off of the top surface of the modular flooring as a result of the step between the floor and the top surface. The sharp step around the perimeter of the modular floor can also result in tripping or other safety concerns. The present invention describes methods and apparatus that provide an edge around at least a portion of a modular floor perimeter. Consequently, ingress and egress to the modular floor is simplified and safer than prior flooring systems. While the edge and flooring systems shown and described below include embodiments, the application of principles described herein to are not limited to the specific devices shown. The principles described herein may be used with any flooring system. Therefore, while the description below is directed primarily to interlocking plastic modular floors, the methods and apparatus are only limited by the appended claims.

As used throughout the claims and specification the term "rectangle" or "rectangular" refers to a four-sided object with four right angles. "Modular" means designed with regular or standardized units or dimensions, as to provide multiple components for assembly of flexible arrangements and uses. The words "including" and "having," as used in the specification, including the claims, have the same meaning as the word "comprising."

Figures 1A, 1B, 1C:
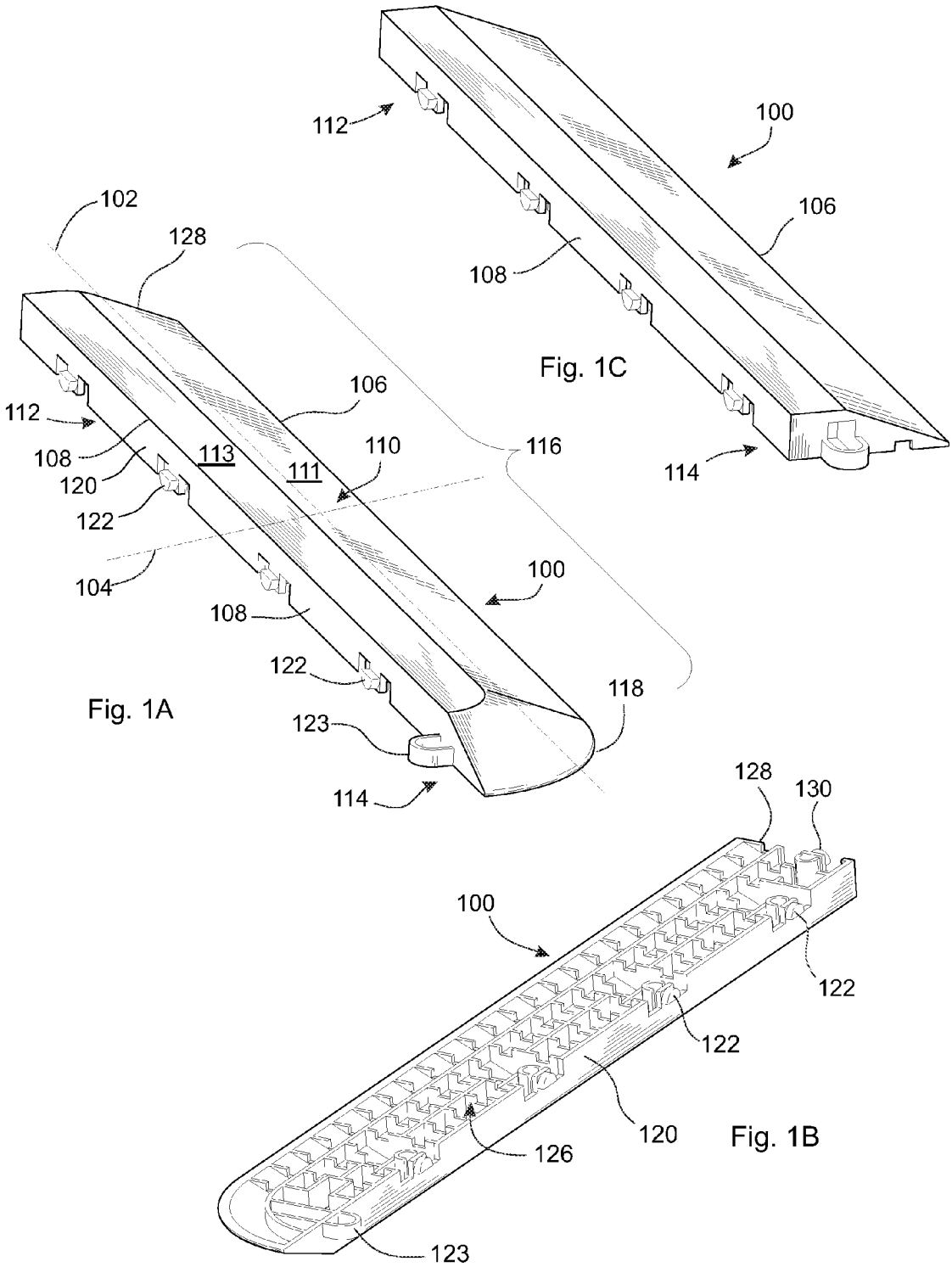
FIG. 1A is a top perspective view of a modular floor edge ramp according to one embodiment of the present invention.
FIG. 1B is a bottom perspective view of the modular floor edge ramp of FIG. 1A.
FIG. 1C is a top perspective view of a modular floor edge ramp without a rounded corner according to one embodiment of the present invention.

Referring now to the drawings, and in particular to FIGS. 1A-1B, one component of a modular floor edge system according to principles of the present invention is shown. FIGS. 1A-1B illustrates a ramp, for example a first elongate ramp 100. The first elongate ramp 100 comprises a major axis 102 and a minor axis 104. The first elongate ramp 100 also includes a leading edge 106 arranged adjacent to a support surface such as the ground or a floor. Opposite of the leading edge 106 is a trailing edge 108. The trailing edge 108 is spaced from the support surface. A top surface 110 extends between the leading edge 106 and the trailing edge 108. Accordingly, the top surface 110 tapers from a first height above the support surface at the trailing edge 108, to the second height adjacent to the support surface at the leading edge 106 as shown in FIG. 1A. The top surface 110 includes both an angled portion 111 and a substantially horizontal portion 113.

The ramp 100 includes a first end 112 and a second end 114. According to the embodiment of FIG. 1A, the leading edge 106 comprises a substantially straight portion 116, and a rounded corner portion 118 at the second end 114. Alternatively, according to some embodiments such as the embodiment shown in FIG. 1C, there is no rounded corner portion 118 at the second end 114 and the leading edge 106 is substantially identical at both the first and second ends 112, 114. As shown in FIG. 1A, the straight portion 116 is parallel to the major axis 102.

The ramp 100 also includes a substantially vertical back 120 shown more clearly in FIG. 1B. FIG. 1B illustrates the ramp 100 from a bottom perspective view. The substantially vertical back 120 is generally parallel to the major axis 102 and comprises at least one connecting member, for example a plurality of male tabs 122 and a female tab 123, protruding therefrom. The male and female tabs 122, 123 are shown and described in more detail below with reference to FIGS. 3A-3C. The female tab 123 is shown adjacent to, but opposite of, the rounded corner 118. The male tabs 122 are removably attachable to a modular floor tile, such as the modular floor tile 124 shown in FIG. 2. The female tab 123 is connectable to another ramp.

Continuing to refer to FIG. 1B, the ramp 100 includes an open webbed structure 126 that supports the top surface 110 (FIG. 1A). The ramp 100 may comprise plastic or other material and is preferably injection molded. Accordingly, the ramp 100 is strong, lightweight, and inexpensive to manufacture.

Adjacent to the substantially vertical back 120 is a substantially vertical side surface 128. The substantially vertical side surface 128 is generally perpendicular to the vertical back 120. The substantially vertical side surface 128 includes one or more connecting members, such as male tab 130, for attachment with another ramp similar or identical to the ramp 100 shown in FIG. 1B. The male tab 130 may be replaced with a mating female tab (e.g. 123), if desired, to provide for attachment to a ramp with a connecting member of the opposite type. Further, embodiments that do not include the rounded corner portion 118 (such as the embodiment of FIG. 1C) may include either a male or female tab 122, 123 opposite of the tab 130 shown protruding from the side surface 128.

Figure 2:
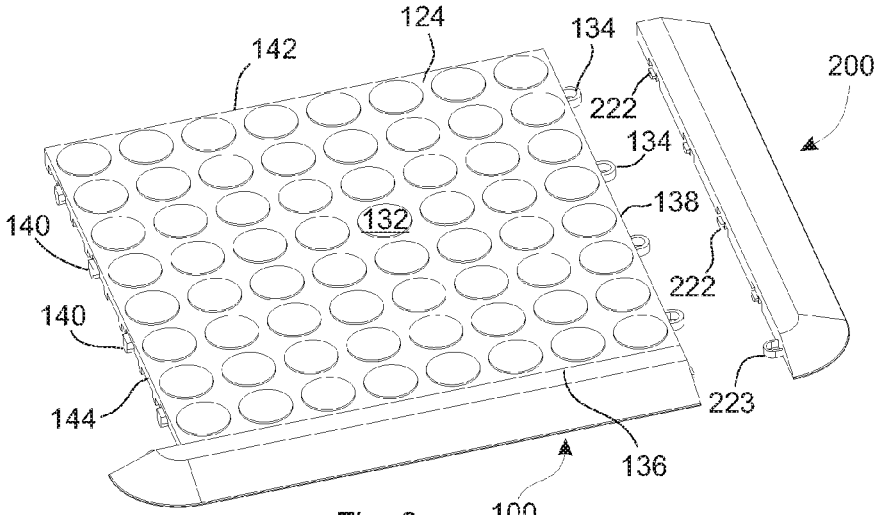
FIG. 2 is a top perspective view of two modular floor edge ramps being attached to a modular floor panel according to one embodiment of the present invention.

Referring next to FIG. 2, two ramps 100, 200 are shown in relation to the modular floor panel 124. The modular floor panel 124 comprises a top surface 132 and a plurality of lateral edge connecting members. According to the embodiment of FIG. 2, the plurality lateral edge connecting members comprise a plurality of female tabs 134 arranged on two adjacent sides 136, 138 of the rectangular modular floor panel 124, and a plurality of male tabs 140 arranged on another two adjacent sides 142, 144 of the modular floor panel 124. The first ramp 100 is shown connected to the modular floor panel 124 at the first lateral side 136. Accordingly, female tabs 134 (not shown) extending from the first lateral side 136 are receptive of the male tabs 122 (FIG. 1B) of the first ramp 100. Likewise, the female tabs 134 of the second lateral side 138 are receptive of the male tabs 222 of the second ramp 200. The attachment of the ramps 100, 200 to the modular floor panel 124 provides a convenient, tapered interface between the lateral sides 136, 138 and the top surface 132. Moreover, other ramps may also, be added to the periphery of the modular floor panel 124.

Figure 3B:
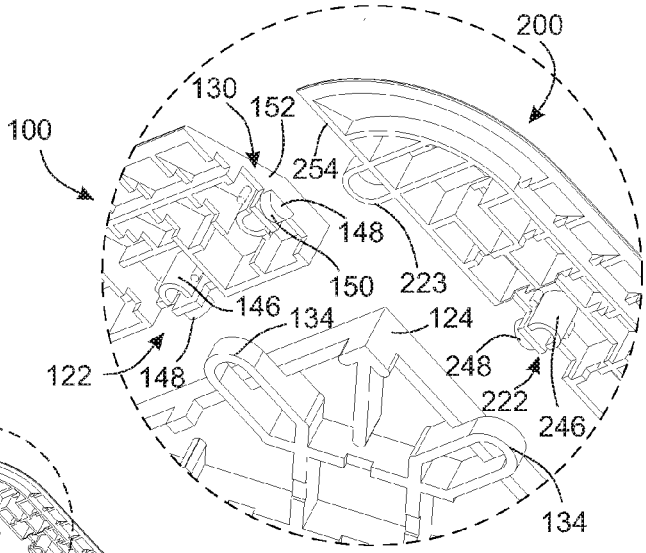
FIG. 3B is a detailed inset of a corner of the modular floor panel shown in FIG. 3A.
Figure 3A:
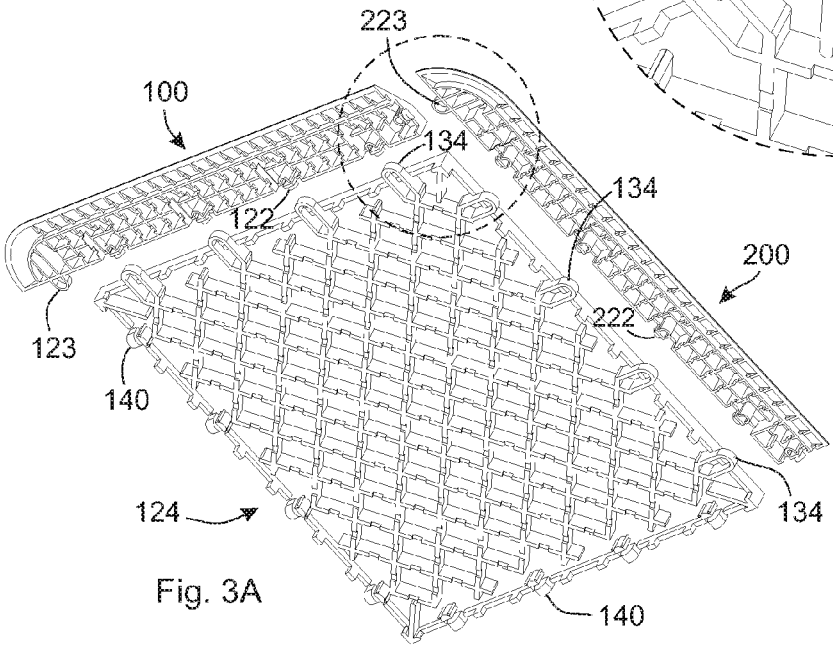
FIG. 3A is a bottom perspective view of two modular floor edge ramps being attached to a modular floor panel according to one embodiment of the present invention.
Figure 3C:
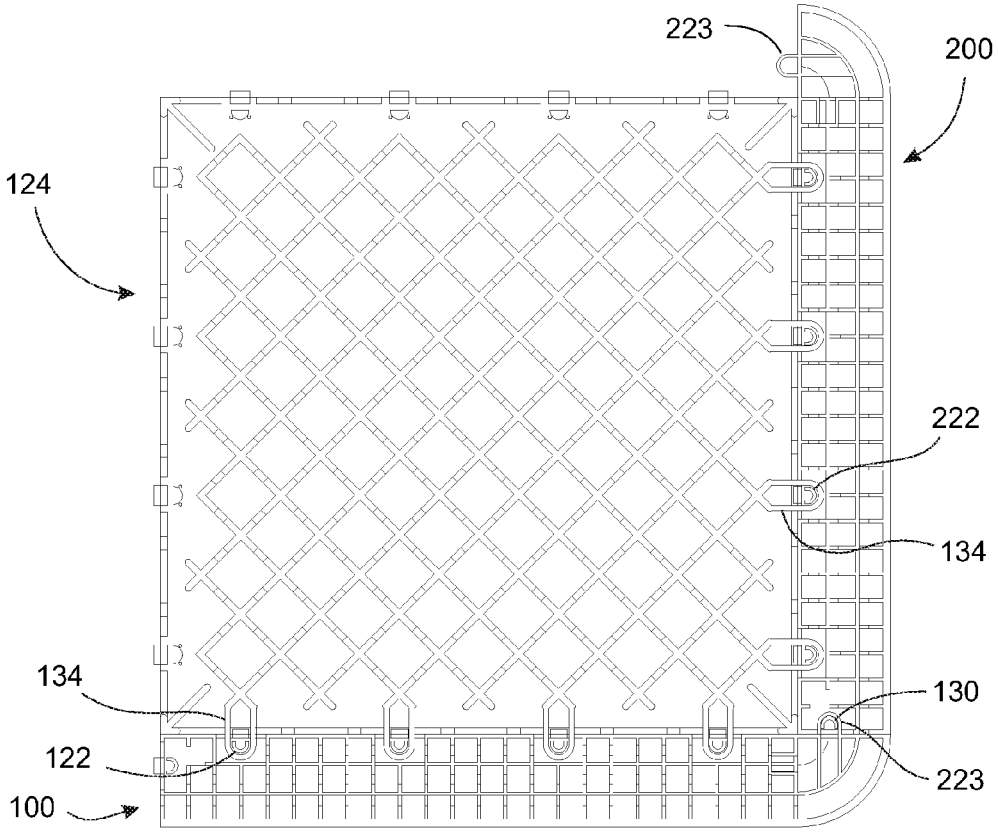
FIG. 3C is a bottom view of the two modular floor edge ramps attached to the modular floor panel according to one embodiment of the present invention.

The connection of the first and second ramps 100, 200 to the modular floor panel 124 is shown in more detail in FIGS. 3A-3C. The male tabs 122, 222 include a generally vertical component which, according to the embodiment of FIGS. 3A-3C, comprises semi-circular posts 146, 246 (FIG. 3B). The male tabs 122, 222 also comprise generally horizontal components which, according to the embodiment of FIGS. 3A-3C, comprise semi circular discs 148, 248 (FIG. 3B). A curved portion 150 of the semi-circular discs 148, 248 faces the floor or ground. The semi-circular discs 148, 248 are received through the looping female tabs 134, and extend at least partially under the modular floor panel 124 to removably secure the ramps 100, 200 to the modular floor panel 124 as shown in FIG. 3C. The looping female tabs 134 each comprise a rigid hoop structure that is completely receptive of the semi-circular discs 148, 248 (FIG. 3B). The semi-circular posts 146, 246 (FIG. 3B) and the semi-circular disc 148, 248 (FIG. 3B) are also rigid but compressible toward one another. When inserted into the female tabs 134, the semi-circular posts 146, 246 (FIG. 3B) and the semi-circular discs 148, 248 (FIG. 3B) maintain a constant pressure against the female tabs 134, thereby securing a connection between desired components (e.g. between two or more modular floor panels 124, between a modular floor panel 124 and a ramp 100, between two or more adjacent ramps 100, 200, etc.). The connection members engage one another such that the different components are joined tightly to one another and provide a consistent upper surface.

Figure 5B:
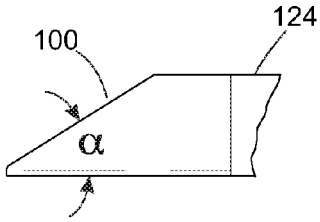
FIG. 5B is a side view of a portion of the tiles and ramps shown in FIG. 5A.
Figure 5A:
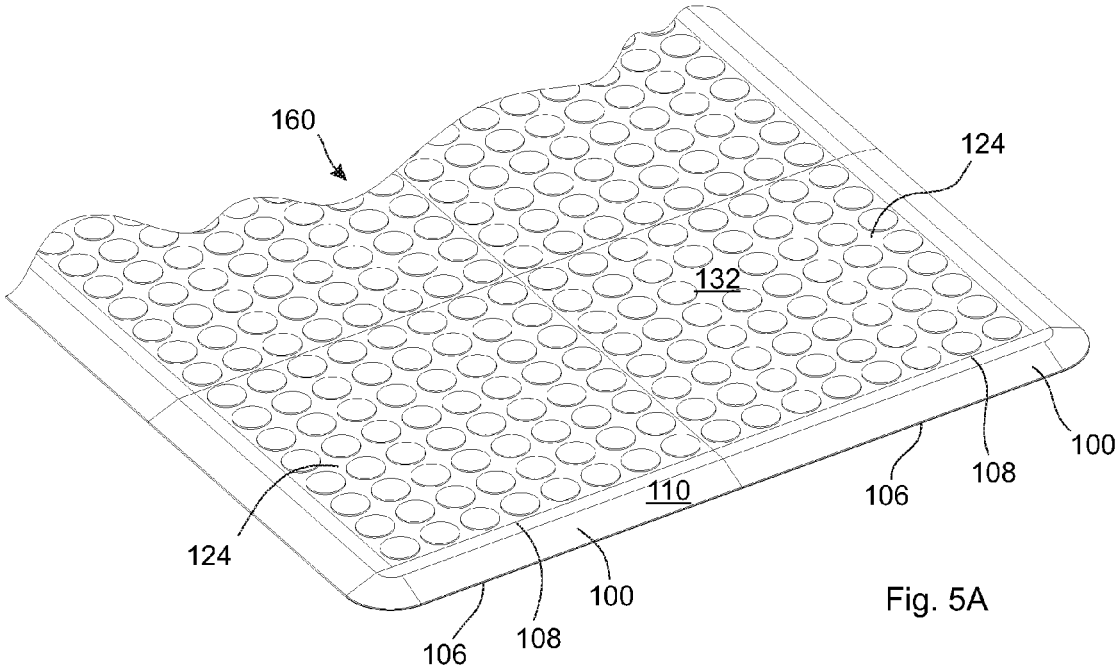
FIG. 5A is a partial perspective view of a plurality of interconnected modular floor tiles with modular edge ramps attached to and extending around a perimeter of the modular floor tiles according to one embodiment of the present invention.

According to the embodiment of FIGS. 3A-3C, a male tab 148 of the first ramp 100 is received by and engages the female tab 223 of the second ramp 200 to secure the first and second ramps 100, 200 together. As shown in FIGS. 3A-3C, the second ramp 200 is removably attached perpendicularly to the first ramp 100. Consequently, an interface 152 of the first ramp 100 with the second ramp 200 is substantially parallel to the minor axis 104 (FIG. 1) of the first ramp 100, and an interface 254 of the second ramp is substantially parallel to the major axis 102 (FIG. 1) of the second ramp 200. However, the first and second ramps 100, 200 may be attached longitudinally as well. FIG. 5A illustrates a combination of ramps 100 arranged longitudinally and perpendicularly to one another around a modular floor 160. The skilled artisan having the benefit of this disclosure will understand that the placement of the connecting members such as the male and female tabs 122, 134 shown in FIG. 3B may be reversed between components.

Figure 4:
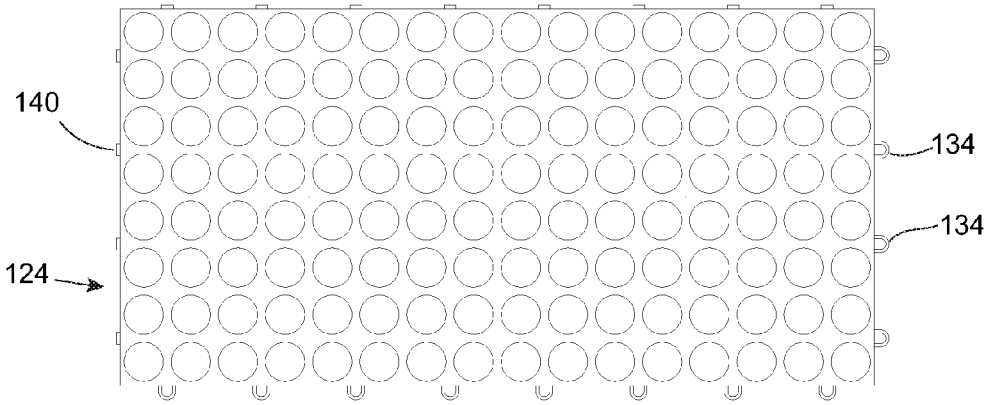
FIG. 4 is a top view of two interconnected modular floor tiles according to one embodiment of the present invention.

Referring to FIG. 4, two or more modular floor panels 124 may be interconnected to form any polygonal shape. Ramps such as the ramps 100, 200 shown in FIGS. 3A-3B may then be attached at least partially around the perimeter of the polygonal shape as shown in FIG. 5A. The tapered surface 110 of the ramp 100 extends from the leading edge 106 adjacent to the support surface or floor to the trailing edge 108 that is preferably flush with the top surface 132 of the modular floor panels 124. An angle $\alpha$ between the floor and the ramp 100 may range between approximately 20 and 60 degrees, preferably between approximately 30 and 50 degrees, more preferably about 45 degrees.

The preceding description has been presented only to illustrate and describe exemplary embodiments of invention. It is not intended to be exhaustive or to limit the invention to any precise form disclosed. Many modifications and variations are possible in light of the above teaching. It is intended that the scope of the invention be defined by the following claims.

What is claimed is:

1. An edge piece for a modular floor comprising:

a front and a back positioned opposite each other, the back including a plurality of connecting members that allow the edge piece to be coupled to modular floor tile that form the modular floor; and a first end and a second end positioned opposite each other;

wherein the edge piece has an elongated shape and the edge piece slopes downward in a transverse direction toward the front to provide a smooth transition from the modular floor to a support surface; and wherein the edge piece slopes downward in a longitudinal direction toward the second end to provide a smooth transition from the modular floor to the support surface.

2. The edge piece of claim 1 wherein one of the connecting members from the plurality of connecting members is positioned on the back surface below where the edge piece slopes downward toward the second end.

3. The edge piece of claim 2 wherein the one connecting member is a female type connecting member.

4. The edge piece of claim 1 wherein the edge piece includes a connecting member at the first end to allow the first end of the edge piece to be coupled to another edge piece.

5. The edge piece of claim 4 wherein the connecting member at the first end of the edge piece is a male type connecting member.

6. The edge piece of claim 1 wherein the plurality of connecting members are loops.

7. The edge piece of claim 1 wherein the edge piece has a rounded corner portion where the front and the second end meet.

8. The edge piece of claim 1 comprising a top surface that includes a substantially horizontal portion which is positioned adjacent to the back of the edge piece.

9. An edge piece for a modular floor comprising:

a front and a back positioned opposite each other, the back including a plurality of connecting members that allow the edge piece to be coupled to modular floor tile that form the modular floor;

a first end and a second end positioned opposite each other; and a leading edge extending along the front and the second end, the edge piece being sloped upward from the leading edge to provide a smooth transition from a support surface to the modular floor;

wherein the edge piece has an elongated shape; and wherein the back extends substantially straight in a lengthwise direction from the first end to the leading edge at the second end.

10. The edge piece of claim 9 wherein one of the connecting members from the plurality of connecting members is positioned on the back surface below where the edge piece slopes upward from the leading edge.

11. The edge piece of claim 10 wherein the one connecting member is a female type connecting member.

12. The edge piece of claim 9 wherein the edge piece includes a connecting member at the first end to allow the first end of the edge piece to be coupled to another edge piece.

13. The edge piece of claim 12 wherein the connecting member at the first end of the edge piece is a male type connecting member.

14. The edge piece of claim 9 wherein the plurality of connecting members are loops.

15. The edge piece of claim 9 wherein the leading edge includes a rounded corner portion where the front and the second end meet.

16. The edge piece of claim 9 comprising a top surface that includes a substantially horizontal portion which is positioned adjacent to the back of the edge piece.

17. An edge piece for a modular floor comprising:

a front and a back positioned opposite each other, the back including a back surface that is substantially vertical and comprises a plurality of connecting members configured to allow the edge piece to be coupled to modular floor tile that form the modular floor;

a first end and a second end positioned opposite each other; and a leading edge extending along the front and the second end, the edge piece being sloped upward from the leading edge to provide a smooth transition from a support surface to the modular floor;

wherein the edge piece has an elongated shape; and wherein one of the connecting members from the plurality of connecting members is positioned on the back surface below where the edge piece slopes upward from the second end.

18. The edge piece of claim 17 wherein the one connecting member is a female type connecting member.

19. The edge piece of claim 17 wherein the edge piece includes a connecting member at the first end to allow the first end of the edge piece to be coupled to another edge piece.

20. The edge piece of claim 17 wherein the plurality of connecting members are female type connecting members.

21. The edge piece of claim 17 wherein the leading edge includes a rounded corner portion where the front and the second end meet.

22. The edge piece of claim 17 comprising a top surface that includes a substantially horizontal portion which is positioned adjacent to the back of the edge piece.

23. An edge piece for a modular floor comprising:

a front and a back positioned opposite each other, the back including a back surface that is substantially vertical and comprises a plurality of connecting members configured to allow the edge piece to be coupled to modular floor tile that form the modular floor;

a first end and a second end positioned opposite each other, the first end including a side surface that is substantially vertical; and a leading edge extending along the front and the second end, the front of the edge piece being sloped upward from the leading edge in a transverse direction to provide a smooth transition from a support surface to the modular floor, the second end of the edge piece being sloped upward from the leading edge in a longitudinal direction to provide a smooth transition from the support surface to the modular floor;

wherein the side surface is perpendicular to the back surface and the leading edge;

wherein the edge piece has an elongated shape; and wherein one of the connecting members from the plurality of connecting members is positioned on the back surface below where the edge piece slopes upward from the second end.

24. The edge piece of claim 23 wherein the leading edge includes a straight portion along the front of the edge piece and a rounded corner portion where the front and the second end of the edge piece meet.

25. The edge piece of claim 23 wherein the one connecting member is a female type connecting member.

26. The edge piece of claim 25 comprising a connecting member positioned on the side surface to allow the first end of the edge piece to be coupled to another edge piece.

27. The edge piece of claim 26 wherein the connecting member on the side surface is a male type connecting member.

28. The edge piece of claim 23 comprising a top surface that includes a substantially horizontal portion which is positioned adjacent to the back of the edge piece.

29. An edge system for a modular floor, comprising:

at least one rectangular floor tile;

at least one first edge piece having an elongated shape and including a front, a back, a first end, a second end, and a leading edge that extends along the front of the edge piece, the first edge piece being sloped downward in a transverse direction toward the leading edge;

at least one second edge piece comprising:

a front and a back positioned opposite each other, the back of the second edge piece including a plurality of connecting members that allow the edge piece to be coupled to the at least one rectangular floor tile;

a first end and a second end positioned opposite each other;

wherein the second edge piece has an elongated shape and the second edge piece slopes downward in a transverse direction toward the front of the second edge piece to provide a smooth transition from the modular floor to a support surface;

wherein the second edge piece slopes downward in a longitudinal direction toward the second end of the second edge piece to provide a smooth transition from the modular floor to the support surface.

30. The edge system of claim 29 wherein one of the connecting members from the plurality of connecting members is positioned on the back surface of the second edge piece below where the second edge piece slopes downward toward the second end of the second edge piece.

31. The edge system of claim 30 wherein the one connecting member is a female type connecting member.

32. The edge system of claim 29 wherein the second edge piece includes a connecting member at the first end of the second edge piece to allow the first end of the second edge piece to be coupled to the first edge piece.

33. The edge system of claim 32 wherein the connecting member at the first end of the second edge piece is a male type connecting member.

34. The edge system of claim 29 wherein the plurality of connecting members are loops.

35. The edge system of claim 29 wherein the second edge piece has a rounded corner portion where the front of the second edge piece and the second end of the second edge piece meet.

36. The edge system of claim 29 wherein the second edge piece comprises a top surface that includes a substantially horizontal portion which is positioned adjacent to the back of the second edge piece.

* * * * *